US011118325B2

(12) United States Patent
Haddorp et al.

(10) Patent No.: US 11,118,325 B2
(45) Date of Patent: Sep. 14, 2021

(54) SUBSEA TRENCHER AND METHOD FOR SUBSEA TRENCHING

(71) Applicant: BLUEMARINE OFFSHORE YARD SERVICE B.V., Rotterdam (NL)

(72) Inventors: Regina Haddorp, Delft (NL); Alexander Christian Vermeulen, Vlaardingen (NL); Otto Joost Kooy, Amsterdam (NL)

(73) Assignee: BLUEMARINE OFFSHORE YARD SERVICE B.V., Rotterdam (NL)

( * ) Notice: Subject to any disclaimer, the term of this patent is extended or adjusted under 35 U.S.C. 154(b) by 0 days.

(21) Appl. No.: 16/643,630

(22) PCT Filed: Sep. 4, 2018

(86) PCT No.: PCT/NL2018/050567
§ 371 (c)(1),
(2) Date: Mar. 2, 2020

(87) PCT Pub. No.: WO2019/050394
PCT Pub. Date: Mar. 14, 2019

(65) Prior Publication Data

US 2021/0010230 A1 Jan. 14, 2021

(30) Foreign Application Priority Data

Sep. 5, 2017 (NL) ..... 2019487

(51) Int. Cl.
*E02F 5/10* (2006.01)
*E02F 5/14* (2006.01)
*E02F 3/88* (2006.01)

(52) U.S. Cl.
CPC ..... *E02F 5/104* (2013.01); *E02F 5/145* (2013.01); *E02F 3/8866* (2013.01); *E02F 5/107* (2013.01)

(58) Field of Classification Search
CPC . E02F 5/104; E02F 5/145; E02F 5/107; E02F 3/8866; E02F 5/10; F16L 1/12; F16L 1/028
See application file for complete search history.

(56) References Cited

U.S. PATENT DOCUMENTS 3,583,170 A * 6/1971 DeVries ..... E02F 5/108 405/162
3,751,927 A * 8/1973 Perot, Jr. ..... E02F 5/104 405/163

(Continued)

FOREIGN PATENT DOCUMENTS

| | | | |
|---|---|---|---|
| GB | 2014538 | A | 8/1979 |
| WO | 2009141409 | A2 | 11/2009 |
| WO | 2017017599 | A1 | 2/2017 |

OTHER PUBLICATIONS

International Search Report and Written Opinion for the International Patent Application No. PCT/NL2018/050567, dated Jan. 23, 2019, 13 pages.

*Primary Examiner* — Edwin J Toledo-Duran
(74) *Attorney, Agent, or Firm* — Kacvinsky Daisak Bluni PLLC

(57) ABSTRACT

A subsea trencher for arranging at least partly into the seabed a subsea pipeline, includes
at least one cart that separately carries at least one trench tool and is configured to run along the subsea pipeline. trench tool is configured to work the seabed underneath the subsea pipeline.
A subsea support frame carries heavy subsea equipment connected to the trench tool for operating the trench too.
When the subsea support frame is fixed to the cart, the subsea trencher is configured to load the assembled weight of the cart and subsea support frame onto the subsea pipeline as the subsea trencher runs on the subsea pipeline.

(Continued)

When the subsea support frame is separate from the cart, the subsea support frame is configured to be suspended above the seabed or arranged beside the subsea pipeline at a distance from the subsea pipeline as the cart runs along the subsea pipeline.

21 Claims, 6 Drawing Sheets

(56) References Cited

U.S. PATENT DOCUMENTS

| | | | | |
|---|---|---|---|---|
| 4,087,981 | A | 5/1978 | Norman | |
| 6,022,173 | A | 2/2000 | Saxon | |
| 6,939,082 | B1 * | 9/2005 | Baugh | B08B 7/0071 405/145 |
| 9,745,716 | B1 * | 8/2017 | Wilson | E02F 3/9206 |
| 2003/0010094 | A1 * | 1/2003 | Tucker | F16L 1/26 73/49.5 |
| 2012/0114420 | A1 * | 5/2012 | Lazzarin | F16L 1/163 405/171 |
| 2016/0083928 | A1 * | 3/2016 | Formenti | E02F 5/109 405/160 |

* cited by examiner

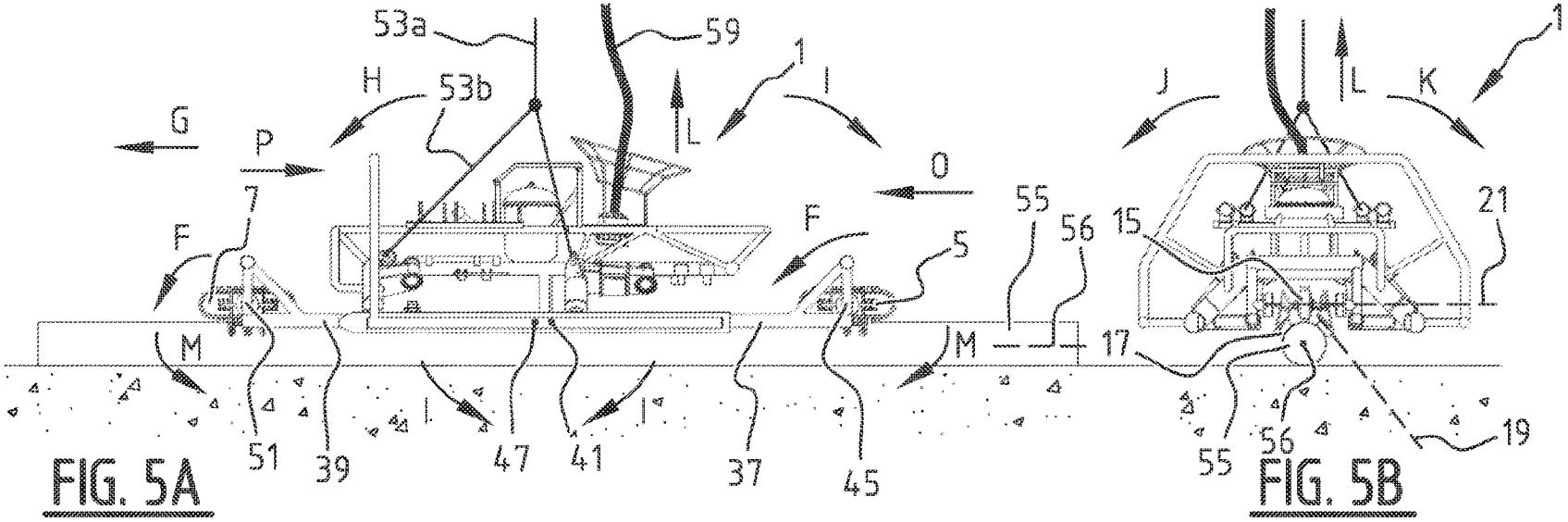
FIG. 5B
FIG. 5A
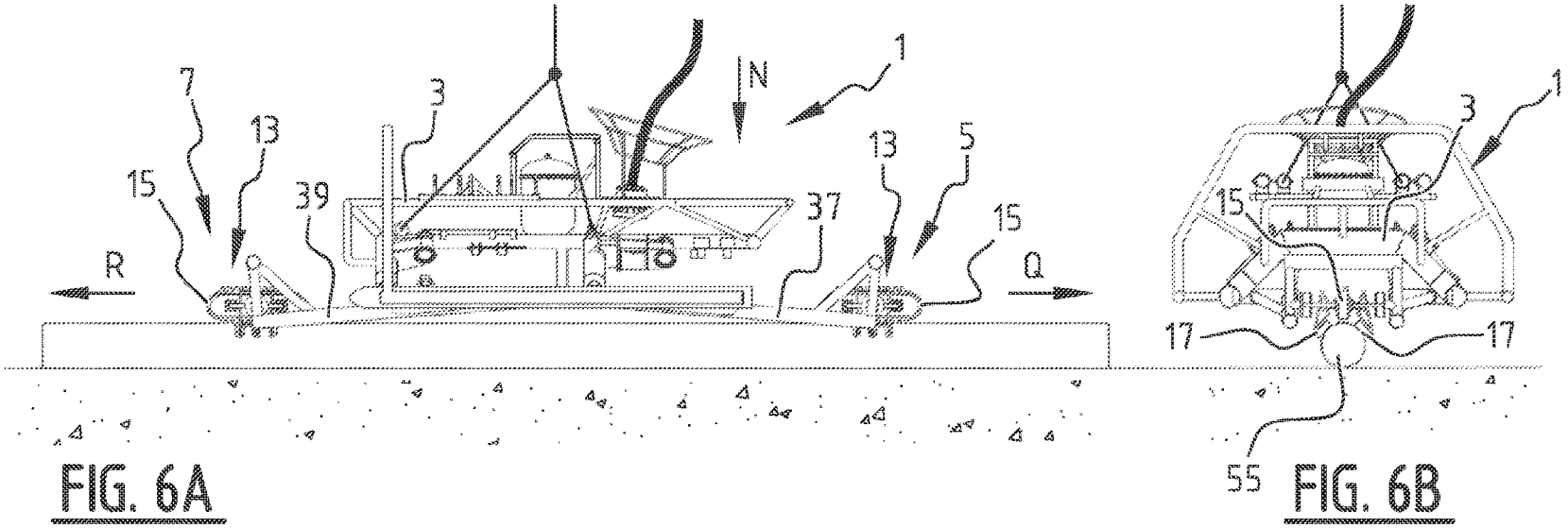
FIG. 6B
FIG. 6A

SUBSEA TRENCHER AND METHOD FOR SUBSEA TRENCHING

This is a national stage application filed under 35 U.S.C. § 371 of pending international application PCT/NL2018/050567, filed Sep. 4, 2018, which claims priority to Netherlands Patent application NL 2019487, filed Sep. 5, 2017, the entirety of which applications are hereby incorporated by reference herein.

The present invention relates to the laying of subsea pipeline. In particular the present invention relates to so-called subsea trenching, a method by means of which a pipeline is arranged in a trench as a means of safeguarding the pipeline. More in particular, the present invention relates to so-called post-lay trenching, a method of subsea trenching that is performed after laying a pipeline on the seabed, i.e. a method for arranging a pipeline that lies on the seabed at least partly into the seabed.

In post-lay trenching a subsea pipeline that lies on the seabed is arranged in a trench by working the seabed underneath the pipeline. In particular seabed is removed or fluidized underneath the subsea pipeline such that the subsea pipeline that was lying on top of the seabed is at least partly arranged in the seabed.

For post-trenching so-called subsea trenchers are used. Known subsea trenchers are designed as a unit that straddles the pipeline and that has arranged thereon trench tools, driven wheels for supporting the subsea trencher on and transporting it over the seabed on both sides of the pipeline and for moving the subsea trencher along the pipeline, and subsea equipment associated with the operation of the trencher, such as power supplies for powering the trench tools and the driven wheels. The subsea trencher carries the trench tools along the pipeline while the driven wheels are powered for moving the subsea trencher over the seabed on both sides of the pipeline and while the trench tools are powered.

There are several known post-lay trenching techniques and associated trench tools. A first known technique is jetting, whereby the soil of the seabed beneath the subsea pipeline is loosened, fluidized and/or stirred up by directing jet streams of water under an angle onto the seabed adjacent the pipeline on both sides of the pipeline. The force of the jet streams and the resulting water turbulence loosens the soil underneath the pipeline and brings the soil into suspension. The pipeline lowers into the loosened soil before the soil settles, such that a trench results in which the pipeline is arranged. Subsea trenchers are for this jetting technique provided with trench tools embodied by jet nozzles carried by the subsea trencher in a certain position and angle. A second known technique is mechanical cutting wherein trenching tools embodied by powered chains, like a in a chain saw, or cutter disks are used for digging through and remove soil of the seabed beneath the subsea pipeline. The trench tools for mechanical cutting are inserted into the seabed adjacent the subsea pipeline under angle in order to dig underneath the subsea pipeline.

A drawback of the known straddling subsea trenchers as described herein above is that the operation of the trench tools on the soil underneath the pipeline and adjacent both sides of the pipeline where the trench tool, or in case of jetting where the jet stream, enters into the soil to be able to loosen, dig into, or force aside the soil underneath the pipeline for forming the trench, at the same time destabilizes the surface of the seabed on which the straddling subsea trencher is supported. In particular in conditions wherein the soil is relatively soft and/or wherein a relatively large pipe diameter requires great trenching power and heavy power supplies for proving said great trenching power, the destabilizing of the surface supporting a straddling subsea trencher can cause the subsea trencher to sink into the soil, which prevents the subsea trencher from proper operation and may even damage the pipeline. Sometimes the soil is so soft that even without the destabilizing effect of the trenching operation, the subsea trencher sinks into the soil to an extent that proper operation is prevented. Furthermore, relatively soft soil may provide insufficient grip on the seabed for moving the subsea trencher along the pipeline, thereby preventing proper operation of the subsea trencher. Still further insufficient grip on the seabed may prevent proper steering of the subsea trencher along the pipeline. The latter may cause the pipeline to act as a guide rail for the subsea trencher, which may subject the pipeline to high loads.

An example of a known pipeline trenching apparatus is disclosed by prior-art publication WO 02/33180. Said apparatus is configured for entrenching cables and pipes with a diameter that is relatively small in comparison to the dimensions of the apparatus and comprises a jetting arm assembly with thereon mounted nozzles for the excavation of trenches. This known apparatus further comprises rotatable threads or skids for efficient movement across the seabed. However, in operating conditions wherein the underlying soil is relatively soft and/or the trench tool destabilizes the seabed to the extent that the trenched may become entrenched and/or wherein a pipe with a relatively large diameter is to be entrenched, the drawbacks described above are encountered when using the apparatus disclosed by WO 02/33180.

U.S. Pat. Nos. 2,879,649 and 4,112,695 also disclose trenching devices for entrenching cables or pipelines into the seabed. Both devices comprise skids on which they support on and are transported over the seabed as they are being towed onward by a towing vessel. The two devices respectively comprise additional means for ensuring that cuttings from the formed trench are discharged away from the device, so as to not fall back into the trench as it is being dug; and means for ensuring an effective removal of slurry from a trench even when said trench is being formed at a relatively great depth surrounded by ambient water with great pressure. Like the apparatus disclosed by WO 02/33180, neither of the devices disclosed by U.S. Pat. Nos. 2,879,649 and 4,112,695 comprise means for addressing the drawbacks outlined above.

Lastly, an additional device belonging to the known prior-art is disclosed by publication GB 2545925, comprising a subsea plough designed specifically for entrenching flexible cables, such as power cables, by performing a ploughing action on the seabed.

In summary, all the above mentioned prior art publications exhibit the common characteristics of a unitary construction carrying all the required equipment, with the construction defining a portal which straddles the pipeline and runs on and over the seabed with support on the seabed formed by wheels or skids, when transported along the pipeline to be entrenched, with the risk of being entrenched in the seabed. It should be noted here that to release an entrenched prior art subsea trencher causes delays, is costly, and often required some other subsea vehicle to be submerged and travel to the site of the entrenched entrencher, to effect its release.

The present invention has as one of its objectives to provide an improved subsea trencher and method of subsea trenching.

Thereto the present invention provides a subsea trencher for arranging at least partly into the seabed a subsea pipeline lying on the seabed, wherein the subsea trencher comprises at least one cart that separately carries at least one trench tool and is configured to run along the subsea pipeline, wherein the trench tool is configured to work the seabed underneath the subsea pipeline. Further, the subsea trencher comprises a subsea support frame that carries, separately from the cart, heavy subsea equipment connected to the trench tool for operating the trench tool. In embodiments, wherein the subsea support frame is fixed to the cart, the subsea trencher is configured to load at least substantially the assembled weight of the cart and the subsea support frame onto the subsea pipeline as the subsea trencher runs on the subsea pipeline. On the other hand, in embodiments, wherein the subsea support frame is separate from the cart, the subsea support frame is configured to be suspended above the seabed or arranged beside the subsea pipeline at a distance from the subsea pipeline as the cart runs along the subsea pipeline.

The provision according to the present invention of at least one cart that separately carries at least one trench tool along the subsea pipeline, allows for the cart to carry the at least one trench tool along the subsea pipeline, and other heavy subsea equipment for operating the subsea trencher is carried by the frame. Thereby, the subsea support frame may even further be mechanically separate from the cart. This is to say that connections must be present between the heavy subsea equipment and the trench tool in particular and/or the cart more in general, but the net weight of the separate cart and frame can hereby be separated and load may be distributed over either the seabed or the pipeline. Relative to the known straddling subsea trenchers, by separating the trench tool on the cart from the other subsea equipment for the trench tool on the support frame, it is no longer required for the unitary embodiments known from the aforementioned prior art publications to carry the trench tool(s) as well as all the power supplies and other subsea equipment and straddle the pipeline with the risk of this unitary configuration of the prior art trenchers getting themselves entrenched. According to the present invention, the cart may advantageously straddle the pipeline or support on and run over the pipeline, while other subsea equipment is supported on the subsea support frame at another location away from where the cart runs along the pipeline, such as suspended or hovering in the sea. As an alternative for the frame hovering or being suspended in the sea, i.e. above the seabed, the frame can move with the cart over the seabed on its own transporter to be supported by and run over or support on the seabed at a location away from the pipeline where the seabed is for instance more stable than adjacent the pipeline, while the stability of the seabed near the excavating trench tool in action is jeopardized by ongoing entrenching operations. Additionally or alternatively, the subsea support frame may be temporarily positioned stationary on the seabed at a distance from where the cart is following the pipeline for trenching, for the subsea support frame to be hoisted regularly for displacement thereof in correspondence with progress of the cart along the pipeline to be set down on the seabed again in the vicinity of the cart, sufficiently close for power supply and other subsea equipment functions for the cart and the trench tool carried thereby. Additionally or alternatively, the subsea support frame may move ahead of or follow the cart, while supporting the heavy load of the frame and the subsea equipment carried thereby on the pipeline and running on and over the pipeline. It is of importance in all these possible embodiments to allow only a predetermined distance between the cart and the subsea support frame to continuously enable power supply, and the like, to the cart. This advantageously reduces the weight of the cart loaded onto and running over the pipeline or to be supported on the seabed adjacent the pipeline, thereby allowing a lower load on and less risk of damage to the pipeline or allowing the cart of the subsea trencher with the trench tool to properly operate and not get entrenched itself, even in situations where the weight that can be supported by the soil of the seabed adjacent the subsea pipeline is limited. On the other hand if the cart with the trench tool does get entrenched, a mere tug on a hoist line between the cart and a support and/or accompanying surface vessel may already suffice to free the cart.

According to the present invention the trencher is configured to be run on the subsea pipeline, when the subsea support frame is fixed to the cart. This results in the same effective weight of the trencher with the fixedly connected cart and frame to be practically equal to that of a prior art trencher straddling the pipeline and supporting on the seabed. Running the trencher on the subsea pipeline allows for reducing the weight to be supported on the seabed on both sides of the pipeline, since the weight of the trencher is supported by the pipeline, and not by the seabed. Relative to the known straddling subsea trenchers, by transferring the weight load of a prior art unitary embodiment, also carrying the heavy subsea equipment necessary for operating the trench tool, that straddles the pipeline, from the seabed to the subsea pipeline, the seabed on both sides of the pipeline is no longer required to support the weight of the unitary trencher, for which the pipeline is naturally required to be able to support the combined weight of the unit assembled from the mutually fixed cart and frame, that carries the trench tool on the cart part and power supplies and other subsea equipment on the frame. With the trencher running on the subsea pipeline, it is therefore possible to support and load the assembled weight of the combined unit that carries all of the trench tool and the power supplies and other subsea equipment on the pipeline. The seabed adjacent the subsea pipeline on both sides thereof is then no longer required to support the subsea trencher, and sinking the pipeline into a formed trench is promoted by the weight of the combined unit that carries all of the trench tool and the heavy power supplies and other subsea equipment on the pipeline. Furthermore, running and loading the trencher on the subsea pipeline may provide improved alignment of the trench tool relative to the subsea pipeline, even in case of an uneven or remoulded seabed. Thus, by the trencher that runs on the subsea pipeline, proper alignment of the trench tool relative to the subsea pipeline can be ensured.

In a preferred embodiment the subsea trencher according to the invention, it is the cart thereof, that is configured run on the subsea pipeline.

In a particularly preferred embodiment, the subsea support frame is configured to be suspended from a surface vessel. Suspending the subsea support frame above the seabed by means of a surface vessel at the sea surface, allows for suspending the subsea support frame above or beside the pipeline. As the cart runs along or possibly even over the subsea pipeline, a need for the use of buoyancy modules or the like can be obviated. This is advantageous in that the use of such buoyancy modules is costly and more importantly, is of limited use at great depth.

In a preferred embodiment of the subsea trencher according to the invention, the subsea trencher further comprises a connecting structure connecting the cart and the subsea support frame. The connecting structure provides a path along which connections between subsea equipment carried by the cart and subsea equipment carried by the subsea support frame can be arranged. For instance in an embodiment wherein trench tools embodied by jet nozzles are carried by the cart and the subsea support frame carries jetting pumps that embody part of the power supply of the jet nozzles, conduits connecting the jetting pumps to the jet nozzles are advantageously arranged along the connecting structure.

In an advantageous embodiment the connecting structure is configured to allow relative motion between the cart and the subsea support frame. This is to prevent that certain motions of one of the cart and the subsea support frame are detrimental for operation of the other one of the cart and the subsea support frame. As a first example, in case the subsea support frame is suspended from a surface vessel and is subject to heave motion of the surface vessel, heave motion of the subsea support frame would be detrimental to the operation of the subsea trencher in case the heave motion would be transferred to the cart, since the heave motion would lift the cart and the trench tool carried by the cart away from the pipeline. By configuring the connecting structure to allow relative heave motion between the suspended subsea support frame and the cart, heave motion of the subsea support frame is not transferred to the cart.

In an advantageous embodiment the connecting structure is configured to allow at least one degree of freedom of relative motion between the cart and the subsea support frame while restricting at least one other degree of freedom of relative motion between the cart and the subsea support frame. This allows for using one of the cart and the subsea support frame to support the other one of the cart and the subsea support frame in order to prevent certain undesired motions of the other one of the cart and the subsea support frame that are detrimental for the operation of the subsea trencher, while still allowing certain relative motions that are desired for proper operation of the subsea trencher. For instance in case the cart is configured to run on the subsea pipeline, rolling motion of the cart and the trench tool carried by the cart about the longitudinal axis of the subsea pipeline is detrimental to the operation of the subsea trencher. In case the subsea support frame is suspended from a surface vessel, the suspended subsea support frame may be used as a support against rolling of the cart about the longitudinal axis of the subsea pipeline by configuring the connection structure to restrict relative rolling motion between the cart and the subsea support frame, while allowing relative heave motion between the cart and the subsea support frame.

In view of the above, in an advantageous embodiment the subsea support frame is configured to be suspended above or beside the pipeline, while the cart is configured to run along the subsea pipeline, and the connecting structure is configured to allow heave motion of the subsea support frame relative to the cart.

In an advantageous embodiment the subsea support frame is configured to be suspended above or beside the pipeline, while the cart runs along the subsea pipeline, and the connecting structure is configured to restrict swaying and/or surging motion of the subsea support frame relative to the cart. According to this embodiment, the cart may be used as a support to restrict swaying and/or surging motion of a suspended subsea support frame. In this embodiment contact between the cart and the subsea pipeline and/or the seabed, may be used to restrict undesired swaying and/or surging motion of the subsea support frame that may be the result of the subsea support frame being suspended from the surface vessel like a pendulum.

In view of the above described detrimental effect of rolling of the cart in case the cart is configured to run on the subsea pipeline, the connecting structure is in an advantageous embodiment configured to restrict rolling motion of the cart relative to the subsea support frame.

In an advantageous embodiment the connecting structure is passive. In other words, advantageously, the connecting structure allows and/or restricts relative motion between the cart and the subsea support frame passively, i.e without using actuators for actively influencing relative motions between the cart and the subsea support frame.

In an advantageous embodiment the connection structure comprises a connection arm that is at one end thereof rotatable connected to the subsea support frame and at another end thereof rotatable connected to the cart. Such an connecting arm provides a simple and robust embodiment of a connecting structure as described above. For instance, by advantageously connecting one end of the connection arm to the subsea support frame by means of a first hinge that allows for rotation about a, in use, substantially horizontal first axis of rotation, and connecting the other end of the connecting arm to the cart by means of a second hinge that allows for rotation about a, in use, substantially horizontal second axis of rotation parallel to the first axis of rotation, relative heave motion between the subsea support frame and the cart is allowed in a simple and robust way with only one connection arm and two hinges.

In a preferred embodiment the at least one cart includes a plurality of carts, each cart carrying at least one trench tool. This allows the seabed underneath the subsea pipeline to be worked by the trench tools carried by the plurality of carts at a plurality of locations along a certain length of the subsea pipeline, thereby allowing the subsea pipeline to gradually sink into the seabed while the carts run along the subsea pipeline.

In an advantageous embodiment the subsea trencher comprises a plurality of connecting arms that are each at one end thereof rotatable connected to the subsea support frame and at an another end thereof rotatable connected to at least one of the carts.

In an advantageous embodiment the connecting arms are rotatable connected to the subsea support frame with a respective hinge, and the respective hinges are closely grouped, preferably in one group. In an embodiment wherein a plurality of connecting arms are provided, each rotatable connected to the subsea support frame at a respective hinge, by closely grouping hinges at the subsea support frame, the effect of tilting of the subsea support frame about a tilting axis that is parallel to parallel axes of rotation of the grouped hinges, on the carts connected to the subsea support frame via respective connection arms can be limited.

In an advantageous embodiment of the subsea trencher according to the invention the subsea trencher has at least one wheel that is configured to support on the subsea pipeline to load at least substantially the assembled weight of the cart and subsea support frame onto the subsea pipeline. This allows the trencher to be supported and/or guided by the subsea pipeline while the trencher runs along the subsea pipeline. Preferably the cart of the trencher comprises the support wheel.

In an advantageous embodiment the at least one wheel includes a tracked wheel set. This allows the wheels of the cart to have a relatively large contact area with the surface of the subsea pipeline, which is in particular advantageous when traction is relevant, for in case of driven wheels. Furthermore, a tracked wheel set allows the cart to smoothly pass recesses or protrusions of the surface of the subsea pipeline, for instance at field joint locations along the subsea pipeline.

In an advantageous embodiment the tracked wheel set comprises exchangeable track pads and/or exchangeable track shoes. This advantageously allows for simple and time efficient adapting of the subsea trencher to a specific properties of the of the subsea pipeline to be arranged at least partly into the seabed, by exchanging track pads and/or track shoes. For instance exchangeable track pads and/or exchangeable track shoes make it possible to adapt the tracks to the specific diameter of the subsea pipeline, i.e thicker pads for smaller diameters and thinner pads for larger diameters. Furthermore, exchangeable track pads and/or exchangeable track shoes make it possible to adapt the tracks in order to take into account pipeline assets, such as anodes and filed joints. For instance, the position or arrangement of the track pads may be changed by having exchangeable track pads and/or exchangeable track shoes, which may allow for putting track pads in an arrangement or position wherein contact between the track pads and pipeline assets is avoided. Alternatively, track pads made of a relatively soft and/or elastic compound may be arranged on the tracks allowing the track pads to drive over pipeline assets without damaging the pipeline assets and/or the track pads.

In an advantageous embodiment the at least one wheel includes a driven wheel for transport of the subsea trencher supported on the pipeline. This advantageously allows for moving the cart along the subsea pipeline by driving the driven wheel. Driving the cart along the subsea pipeline by providing the cart with a driven wheel allows for particular good control over the moving of the cart and the trench tool carried by the cart along the subsea pipeline and thus good control over the working of the seabed underneath the subsea pipeline.

In an advantageous embodiment the driven wheel is driven by a motor, preferably a hydraulic motor, that is carried by the trencher, the motor is connected to a motor power supply, preferably a hydraulic power supply, and at least part of the motor power supply is carried by the subsea support frame. By having the subsea support frame carrying at least part of the motor power supply of the motor that drives a wheel of the cart, the weight of the cart can be reduced.

In an advantageous embodiment the subsea trencher comprises at least two driven wheels driven by a respective motor, a control system configured for controlling the drive speed of the driven wheels, wherein the control system is configured to take into account any speed difference between the at least two drive wheels. This feature advantageously reduces wear of components of the carts as a result of speed difference between carts.

In an advantageous embodiment the at least one wheel includes at least two guide wheels that are arranged for preventing side way movement relative to the subsea pipeline. This feature advantageously allows the subsea pipeline to act as a guide for the cart. The guide wheels may be provided with one or more sensors, such as load sensors, that are indicative of the load on the guide wheels. In particular in embodiments where the subsea support frame is connected to at least one cart by means of a connecting structure, increased load on the one or more guide wheels on one side of the pipeline may be indicative of misalignment of the at least one cart and the subsea support frame. In case such increased load is sensed, the subsea support frame may be steered into proper alignment.

In an advantageous embodiment of the subsea trencher according to the invention the trench tool comprises a jet nozzle that is configured to direct a trenching fluid supplied thereto as a jet stream towards the seabed adjacent the pipeline for at least loosening the seabed below the subsea pipeline. In an embodiment thereof, the part of the trench tool power supply that is carried by the subsea support frame comprises a jetting pump that is connected to the jet nozzle for pumping a trenching fluid to the jet nozzle.

In an advantageous embodiment of the subsea trencher according to the invention the trench tool is a mechanical tool that is configured to mechanically work the seabed below the pipeline. In an embodiment thereof the mechanical tool is driven by a hydraulic motor and the part of the power supply that is carried by the subsea support frame comprises a hydraulic pump that is connected to the hydraulic motor for pumping a hydraulic fluid to the hydraulic motor.

The present invention further relates to a method of arranging at least partly into the seabed a subsea pipeline that is laying on the seabed, comprising: separately carrying at least one trench tool along the subsea pipeline by means of a cart that runs along the pipeline; separately from the cart, carrying heavy subsea equipment connected to the trench tool for operating the trench tool, by means of a subsea support frame, when the subsea support frame is fixed to the cart, loading at least substantially the assembled weight of the cart and subsea support frame onto the subsea pipeline as the cart runs on the subsea pipeline, when the subsea support frame is separate from the cart, suspending the subsea support frame above the seabed or arranging the subsea support beside the subsea pipeline at a distance from the subsea pipeline as the cart runs along the subsea pipeline. The method according to the invention and the advantageous embodiments thereof described herein below, have the same advantageous effects as equivalent embodiments of the subsea trencher according to the invention as described herein above.

BRIEF DESCRIPTION OF THE FIGURES

The accompanying drawings are used to illustrate presently preferred non-limiting exemplary embodiments of the subsea trencher and method of the present invention. The above and other advantages of the features and objects of the invention will become more apparent and the invention will be better understood from the following detailed description when read in conjunction with the accompanying drawings, in which:

FIGS. 3A, 4A, 5A, and 6A show in side view the subsea trencher according to the present invention in different situation during operation;

FIGS. 3B, 4B, 5B, and 6B show in frontal view the subsea trencher according to the present invention in the situations of FIGS. 3A, 4A, 5A, and 6A, respectively;

DESCRIPTION OF EMBODIMENTS

Figure 1A:
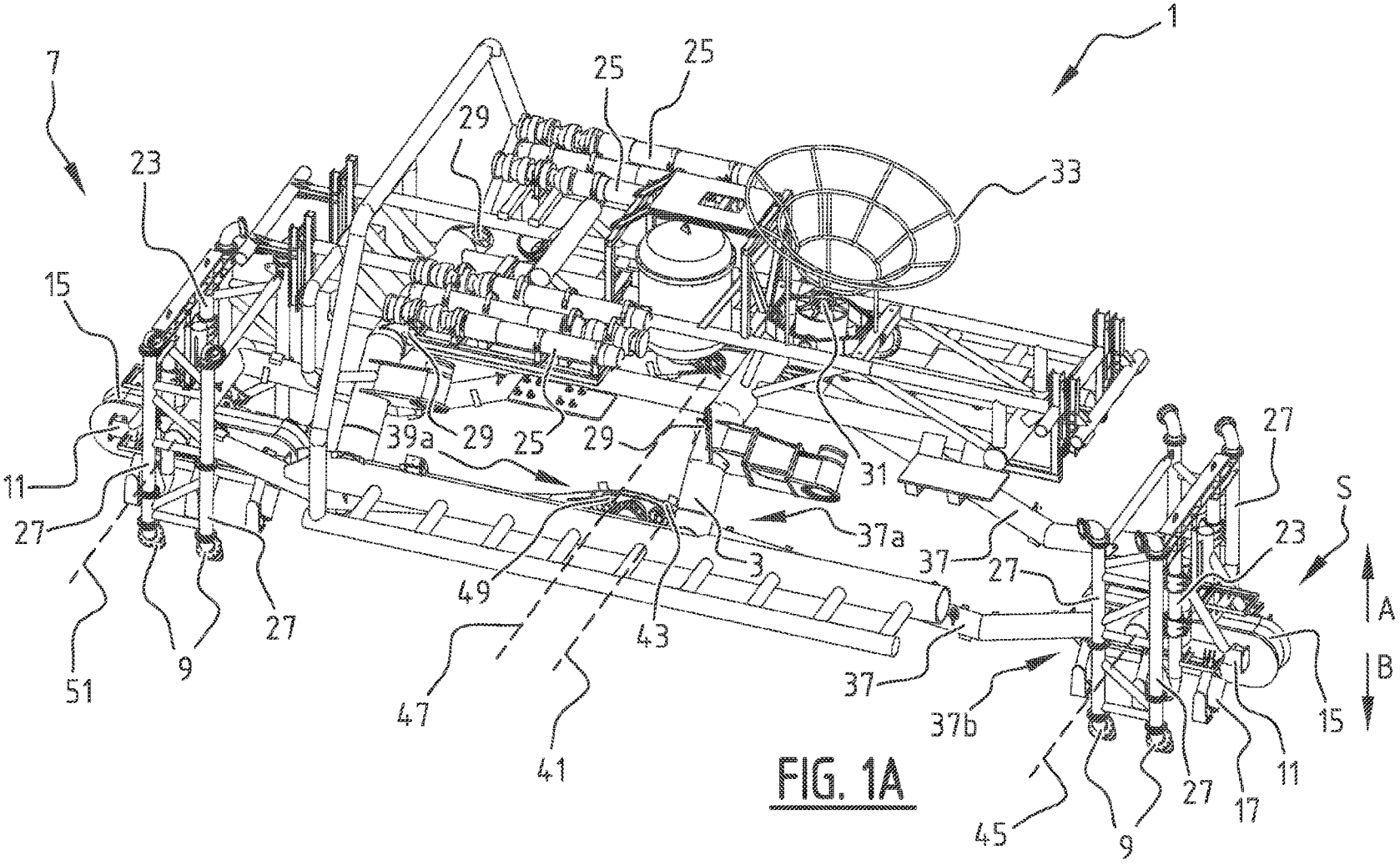
FIGS. 1A and 1B show an embodiment of a subsea trencher according to the present invention in perspective view.
Figure 1B:
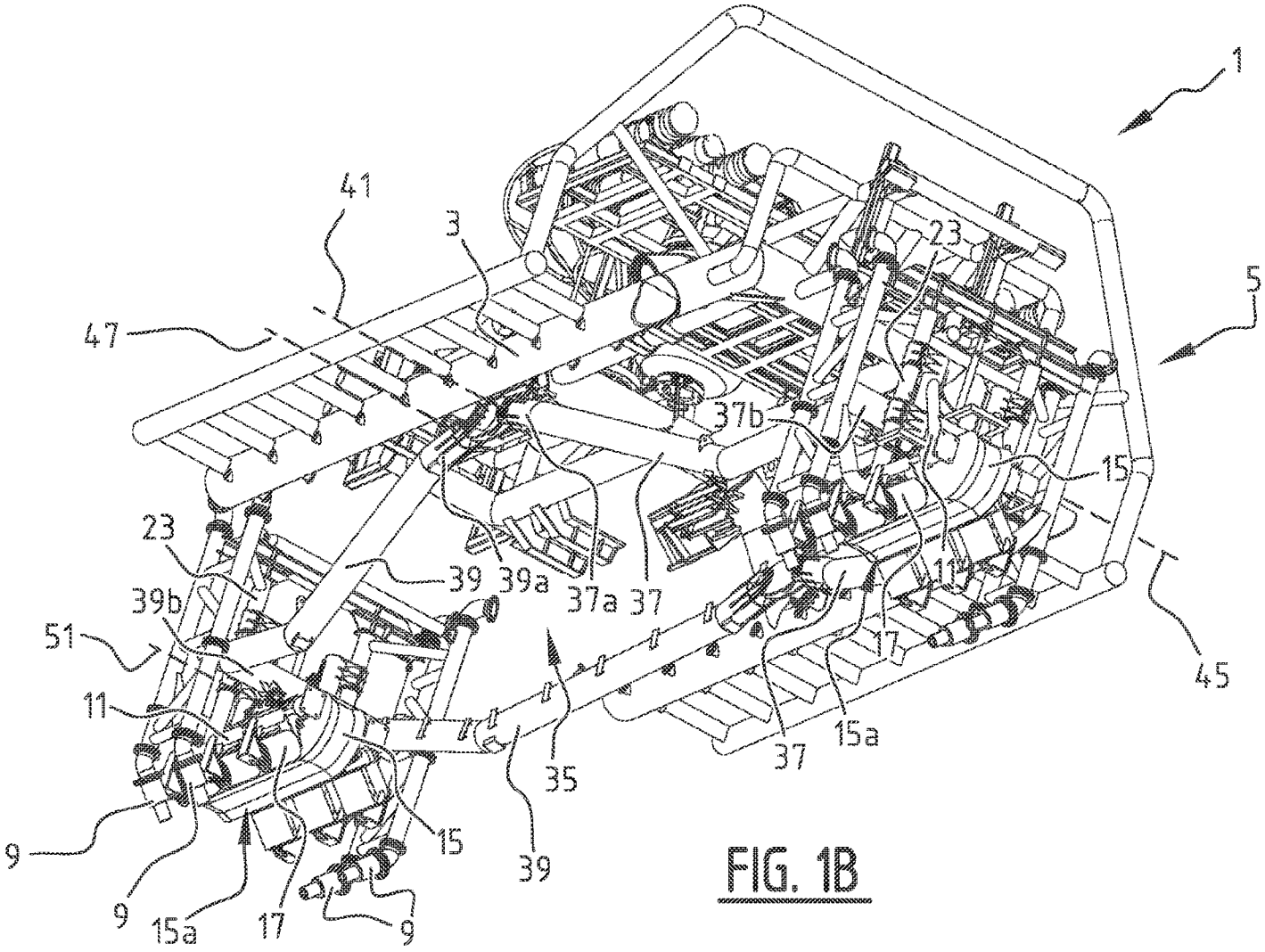
Figure 2:
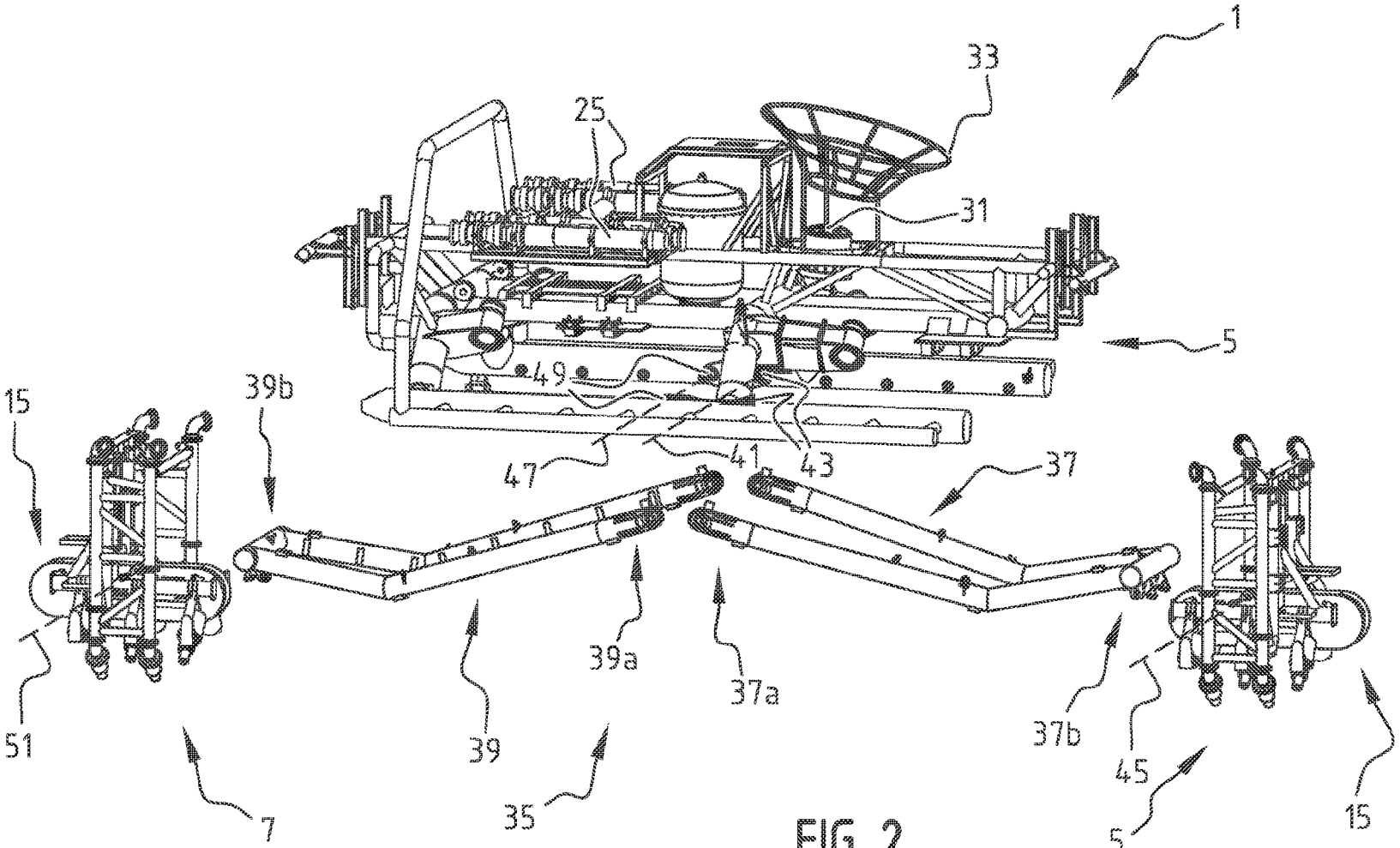
FIG. 2 shows the subsea trencher of FIGS. 1A and 1B in an exploded, perspective view.

FIGS. 1A, 1B, and 2 show in perspective view a subsea trencher 1. The trencher 1 has a subsea support frame 3, a first cart 5, and a second cart 7.

The carts 5, 7 each carry a plurality of trenching tools embodied by jet nozzles or mechanical tools 9. Each cart 5, 7 has a base frame 11 on which are arranged a set of tracked wheels 13, comprising a track 15, and a plurality of guide wheels 17 on both sides of the set of tracked wheels 13. The set of tracked wheels 13 is arranged on the base frame 11 such that the part 15*a* of the track 15 of the set of tracked wheels 13 that is at the underside of the set of tracked wheels 13 can be arranged on a subsea pipeline for supporting the cart 5, 7 on top of a subsea pipeline. The guide wheels 17 are positioned on both sides of set of tracked wheels 13 wherein the axis of rotation 19 of the guide wheels extend under an angle relative to the axes of rotation 21 of the wheels of the set of tracked wheels 13. Movable arranged on the base frame 11 is a trench tool mount 23 on which the jet nozzles or mechanical tools 9 carried by the respective cart 5, 7 are mounted. In the shown embodiment, the trench tool mount 23 can be moved up and down indicated by arrows A and B, respectively, relative to the base frame 11, for setting the distance between the jet nozzles or mechanical tools 9 and the part 15*a* of the track 15 of the set of tracked wheels 13 that is at the underside of the set of tracked wheels 13 that in use rests on a subsea pipeline. The movable trench tool mount 23 thus allows for setting the height of the jet nozzles or mechanical tools 9 above the surface of the seabed on which the subsea pipeline is arranged. Advantageously, the trench tool mount 23 can be moved up and down indicated by arrows A and B, respectively, relative to the base frame 11, by means of one or more actuators. Preferably, the one or more actuators are remote controlled, such that the height of the jet nozzles or mechanical tools 9 above the surface of the seabed on which the subsea pipeline is arranged can be controlled from a surface vessel while the subsea trencher 1 is at the seabed. Preferably, the height of the jet nozzles or mechanical tools 9 above the surface of the seabed can be adjusted while the carts 5, 7 are moved along the subsea pipeline. Such adjustment may be controlled remotely from a surface vessel, and/or may be automatically controlled. In the latter case, a controller may be provided for controlling the one or more actuators based on sensor input provided by sensors that are arranged on the trencher 1, such as sensors that allow for the controller to determine the distance between the jet nozzles or mechanical tools 9 and the seabed.

For powering the trench tools embodied by jet nozzles 9, the subsea trencher 1 is provided with trench tool power supplies embodied by jetting pumps 25. By flexible hoses the jetting pumps 25 are connected to pipes 27 on the carts 5, 7 that in turn are connected to inlets of the jet nozzles 9 via hoses (not shown) for supplying water under pressure to the jet nozzles 9. The water under pressure supplied to the jet nozzles 9 is made by the jet nozzles 9 into a jet stream. While the jet nozzles 9 are arranged on and carried by the carts 5, 7, the jetting pumps 25 are arranged on and carried by the subsea support frame 3. The trench tools embodied by jet nozzles 9 are thus carried by the carts 5, 7, separate from the jetting pumps 25 that are carried by the subsea support frame 3.

Each set of tracked wheels 13 is driven by a motor (not shown), in particular a hydraulic motor. For powering the motors of the driven sets of tracked wheels 13, the subsea trencher 1 is provided with a power supply embodied by a hydraulic power unit including one or more hydraulic pumps. The hydraulic motors of the driven sets of tracked wheels 13 are hydraulically connected to the hydraulic power unit via hoses (not shown) to be supplied with hydraulic fluid under pressure. While the driven sets of tracked wheels 13 and the associated hydraulic motors are arranged on and carried by the carts 5, 7, the hydraulic power unit is arranged on and carried by the subsea support frame 3.

The subsea support frame 3 has attached thereto pad eyes 29 for coupling cables (not shown) thereto for suspending the subsea support frame 2 from a surface vessel. The subsea support frame 3 has also arranged thereon an umbilical connection arrangement 31 surrounded by a basket 33 for connecting an umbilical 59 to the subsea trencher 1 for supplying the jetting pumps 25 and the hydraulic pumps with electric power from the surface vessel from which the subsea support frame 2 is suspended. The umbilical also transfers monitoring signals, such as signals generated by sensors, such as load cells and sonars, from the trencher 1 to the vessel and control signals, such as signals for controlling the hydraulic motors, from the vessel to the trencher 1.

The subsea trencher 1 is provided with a connecting structure 35 connecting the carts 5, 7, and the subsea support frame 3. The connecting structure 35 comprises a first connecting arm 37 and a second connecting arm 39. The first connecting arm 37 is at one end 37*a* thereof rotatable connected to the subsea support frame 3 about a first axis of rotation 41 at a hinge 43 and at an another end 37*b* thereof rotatable connected to the first cart 5 about a second axis of rotation 45. The first axis of rotation 41 and the second axis of rotation 45 of the first connecting arm 37 are parallel. The second connecting arm 39 is at one end 39*a* thereof rotatable connected to the subsea support frame 3 about a first axis of rotation 47 at a hinge 49 and at an another end 39*b* thereof rotatable connected to the second cart 7 about a second axis of rotation 45. The first axis of rotation 47 and the second axis of rotation 51 of the second connecting arm 39 are parallel. The hinges 43, 49, of the connecting arms 37, 39 are arranged at the underside of the subsea support frame 3. The hinges 43, 49 are located such that the first axes of rotation 41, 47 defined by the hinges 43, 49 are closely grouped.

The connecting structure 35 comprising the first and second connecting arms 37, 39, allows relative heave motion between the carts 5, 7 and the subsea support frame 3, thereby providing passive heave compensation. Furthermore, the connecting structure 35 restricts relative rolling motion between the carts 5, 7 and the subsea support frame 3, thereby restricting rolling motion of the carts 5, 7 about the longitudinal axis of the subsea pipeline. Still further, the connecting structure 35 restricts relative sideway swaying motion between the carts 5, 7 and the subsea support frame 3, thereby restricting side way swaying motion of the subsea support frame relative to the carts while the carts run on the subsea pipeline. The functioning of the subsea trencher 1 during operation and in particular the functioning of the connecting structure 35 will be explained in more detail under reference to FIGS. 3A/B to 6A/B.

Figure 3B:
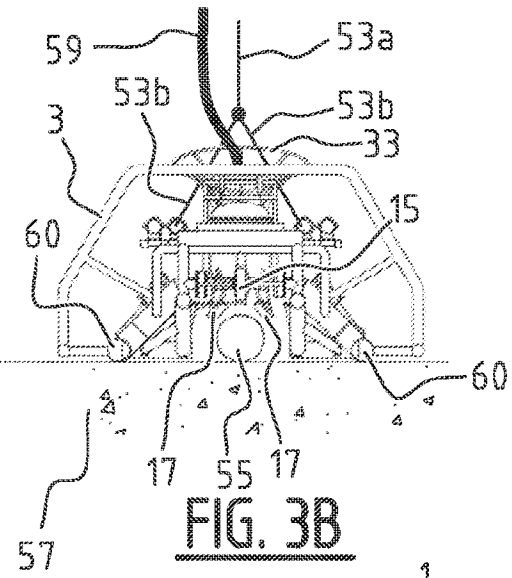
Figure 3A:
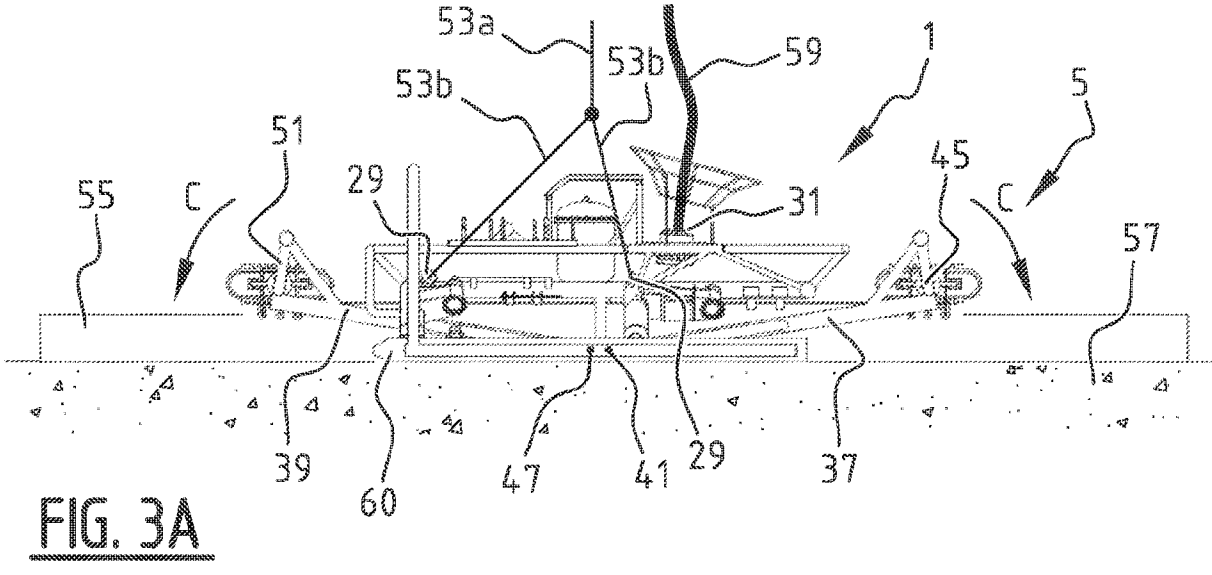

In FIGS. 3A and 3B the subsea trencher 1 of FIGS. 1A, 1B and 2 is shown after being lowered, suspended from cables 53*a*, 53*b* that are coupled to lugs 29, from a surface vessel at the sea surface to a subsea pipeline 55 that has been laid on the seabed 57. While lowering the subsea trencher 1 and arranging the subsea trencher 1 to the subsea pipeline 55, the connecting arms 37, 39 are coupled to the subsea support frame 3 in the position shown in FIG. 3A. As shown in FIG. 3A an umbilical 59 is connected to the umbilical connection arrangement 31 on the subsea support frame 3. In the situation shown in FIGS. 3A and 3B, the wheels 13, 17 are not in contact with the subsea pipeline 55. In the situation shown in FIGS. 3A and 3B, skids 60 provided on the subsea support frame 3 rest on the seabed, while the wheels 13, 17 are not in contact with the subsea pipeline 55. Thus is prevented that in case of a failure of the lifting equipment on the surface vessel, the pipeline is subject to the weight of the subsea support frame 3 and the equipment arranged thereon.

Figure 4B:
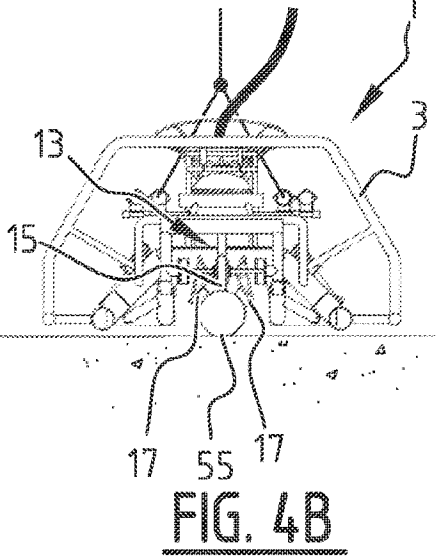
Figure 4A:
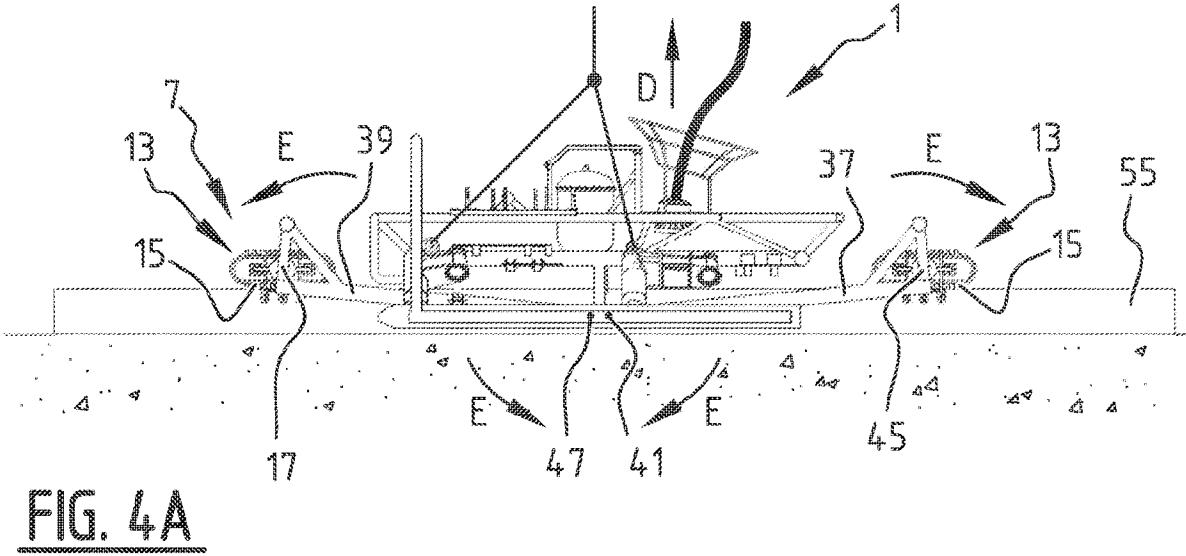

In FIGS. 4A and 4B, the subsea trencher 1 of FIGS. 3A and 3B is shown after the connecting arms 37, 39 have been uncoupled from the subsea support frame 3 from the position shown in FIG. 3A, and have rotated about the first axes of rotation 41, 47 in the direction of arrows C into a position wherein the tracks 15 of the set of tracked wheels 13 and the guide wheels 17 of the carts 5, 7 are in contact with the subsea pipeline 55, such that the carts 5, 7 and the jet nozzles or mechanical tools 9 carried by the carts 5, 7 are supported by the subsea pipeline 55.

After the connecting arms 37, 39 have been uncoupled from the subsea support frame 3 the connecting arms 37, 39 can freely rotate about the axes of rotation 41, 45, 47, 51 relative to the carts 5, 7 and the subsea support frame 3.

In FIGS. 5A and 5B, the subsea trencher 1 of FIGS. 4A and 4B is shown after lifting the subsea support frame 3 up in the direction of arrow D by pulling in the main cable 53*a* at the surface vessel. The lifting resulted in the connecting arms 37, 39 being rotated about the first and second axes of rotation 41, 45, 47, 51 in the direction of arrows E. In the position shown in FIGS. 5A and 5B, the tracks 15 of the set of tracked wheels 13 and the guide wheels 17 of the carts 5, 7 are still in contact with the subsea pipeline 55, such that the carts 5, 7 and the jet nozzles (not shown) carried by the carts 5, 7 are supported by the subsea pipeline 55, whereas the subsea support frame 3 is suspended above the subsea pipeline 55.

In the situation shown in FIGS. 5A and 5B, the carts 5, 7, can be run on and along the pipeline 55 by driving the driven sets of tracked wheels 13, i.e. by pumping hydraulic fluid by means of the hydraulic pumps arranged on the subsea support frame 3 to the hydraulic motors of the sets of tracked wheels 13, thereby causing the tracks 15 to move in the direction indicated by arrows F and the carts 5, 7 to be moved along the pipeline 55 in the direction of arrow G. As a result the jet nozzles that are carried by the carts 5, 7, are moved along the subsea pipeline 55. By at the same time powering the jet nozzles by supplying the jet nozzles with water under pressure using the jetting pumps that are arranged on the subsea support frame 3, jet streams directed by the jet nozzles to the seabed underneath the subsea pipeline 55 cause the soil of the seabed beneath the subsea pipeline to be loosened, fluidized and/or stirred up. The force of the jet streams and the resulting water turbulence loosens the soil underneath the pipeline and brings the soil into suspension. The subsea pipeline 55 lowers into the loosened soil before the soil settles, such that the result is a trench in the seabed in which the subsea pipeline 55 is arranged. The subsea support frame 3 that is suspended above the subsea pipeline 55 and that is connected to the driven carts 5, 7, is moved along with the carts 5, 7 by moving the surface vessel in the same direction as the carts 5, 7. Because the first axes of rotation 41, 47 are arranged closely grouped the one adjacent the other, tilting of the subsea support frame, for instance as a result of a mismatch between the forward speed of the carts 5, 7, and that of the subsea support frame 3, in particular as a result of slipping of the driven wheels of the carts 5, 7, has little influence on the movement of the carts 5, 7 along the subsea pipeline 55. In particular, tilting motion of the subsea support frame 3 about an axis parallel to the first and second axes of rotation 41, 47, in the direction of arrow H or arrow I is transmitted to the carts 5, 7, by the connecting arms 37, 39, and converted into motion of the carts 5, 7, along the subsea pipeline 55 in addition to the motion of the carts 5, 7, that results from driving the driven wheels. Such additional motion of the carts 5, 7 associated with tilting of the subsea support frame 3 may contribute to the undesired slipping of the driven wheels of the carts 5, 7. By closely grouping the first and second axes of rotation 41, 47 the motion transmitted to the carts 5, 7, associated with tilting of the subsea support frame 3 is limited.

The connecting arms 37, 39 are connected to the subsea support frame 3 and carts 5, 7 such that rotation of the connecting arms 37, 39 in the direction of arrow J or arrow K relative to the subsea support frame 3 and the carts 5, 7, about axes of rotation that during operation of the subsea trencher 1 are parallel to the central axis 56 of the subsea pipeline is restricted. Thus, the connecting arms 37, 39 restrict relative rolling motion between the subsea support frame 3 and the carts 5, 7, in the direction of arrow J or arrow K about an axis of rotation that during operation of the subsea trencher 1 is parallel to the central axis 56 of the subsea pipeline. Since the subsea support frame 3 is suspended from a surface vessel, the subsea support frame 3 is prevented from rolling about the central axis 56 of the subsea pipeline 55 in the direction of arrow J or arrow K. Since the subsea support frame 3 is prevented from rolling about the central axis 56 of the subsea pipeline 55, and relative rolling motion between the carts 5, 7, and the subsea support frame 3 about an axis parallel to the central axis 56 of the subsea pipeline 55 is restricted by the connecting arms 37, 39, rolling motion of the carts 5, 7 about the central axis 56 of the subsea pipeline 55 in the direction of arrow J or arrow K is restricted. The connecting arms 37, 39 thus prevent the carts 5, 7 from rotating about the central axis 56 of the subsea pipeline 55 in the direction of arrow J and K, while at the same time allowing relative heave motion between the subsea support frame 3 and the carts 5, 7, as will be explained under reference to FIGS. 6A and 6B.

The connecting arms 37, 39 are connected to the subsea support frame 3 and carts 5, 7 such that rotation of the connecting arms 37, 39 in the direction of arrow J or arrow K relative to the subsea support frame 3 and the carts 5, 7, about axes of rotation that during operation of the subsea trencher 1 are parallel to the central axis 56 of the subsea pipeline is restricted. Thus, the connecting anus 37, 39 restrict swaying motion of the subsea support frame 3 relative to the carts 5, 7, in side way direction transverse to the subsea pipeline 55 while the carts run on the subsea pipeline. The guide wheels 17 restrict side way motion of the carts 5, 7 relative to the subsea pipeline 55. Thus, wile the subsea support frame 3 is suspended from the surface vessel and the carts 5, 7, run on the subsea pipeline 55, the guide wheels 17 and the connecting structure 35 effectively restrict side way swaying motion of the subsea support frame 3 and the carts 5, 7.

In FIGS. 6A and 6B, the subsea trencher 1 of FIGS. 5A and 5B is shown in a situation wherein as a result of an upward heave motion of the surface vessel from which the subsea support frame 3 is suspended, the subsea support frame 3 is lifted up in the direction of arrow L. The lifting resulted in the connecting arms 37, 39 being rotated about the first and second axes of rotation 41, 45, 47, 51 in the direction of arrows M such that the tracks 15 of the set of tracked wheels 13 and the guide wheels 17 of the carts 5, 7 remain in contact with the subsea pipeline 55. Subsequently, the downward heave motion of the surface vessel in the direction of arrow N that follows the upward heave motion, will result in the subsea support frame 3 returning into the position shown in FIGS. 5A and 5B. Thus the upward and downward heave motions do not result in the carts 5, 7, being lifted away from the subsea pipeline. The tracks 15 of the set of tracked wheels 13 and the guide wheels 17 of the carts 5, 7 remain in contact with the subsea pipeline 55, such that the jet nozzles carried by the carts 5, 7 remain at the set height above the surface of the seabed.

The heave motion of the subsea support frame 3 relative to the subsea pipeline 55 and carts 5, 7, running thereon as described herein above under reference to FIGS. 6A and 6B, is transmitted to the carts 5, 7, by the connecting arms 37, 39 and converted into motion of the carts 5, 7, along the subsea pipeline 55 in addition to the motion of the carts 5, 7, that results from driving the driven wheels. In particular, upward heave motion of the subsea support frame 3 in the direction of arrow L is converted by the connecting arms 37, 39 into additional motion of cart 5 in the direction of arrow O and into additional motion of the other cart 7 in the opposite direction of arrow P. Subsequent downward heave motion of the subsea support frame 3 in the direction of arrow N is converted by the connecting arms 37, 39 into additional motion of cart 5 in the direction of arrow Q and into additional motion of the other cart 7 in the opposite direction of arrow R. In order to prevent slipping of the driven wheels as a result of this additional motion, the subsea trencher 1 is provided with a control system that is configured to control the driving speed of the driven wheels while taking into account any speed difference between the carts 5, 7, as a result of the additional motion associated with the heave motion of the subsea support frame 3. When driving the driven sets of tracked wheels 13 in the direction of arrow F, slipping of the sets of tracked wheels 13 during upward heave motion of the subsea support frame 3 in the direction of arrow L can be prevented by decreasing the drive speed of the set of tracked wheels 13 of cart 7 while increasing the drive speed of the set of tracked wheels 13 of cart 5. During the subsequent downward heave motion of the subsea support frame 3 in the direction of arrow N, slipping of the sets of tracked wheels 13 can be prevented by increasing the drive speed of the set of tracked wheels 13 of cart 7 while decreasing the drive speed of the set of tracked wheels 13 of cart 5. The described increase and decrease of the drive speed of the sets of tracked wheels 13 in order to prevent slipping of the sets of tracked wheels 13 is advantageously achieved in the shown embodiment by a control system comprising a hydraulic circuit for providing hydraulic fluid to the hydraulic motors driving the respective sets of tracked wheels 13. In the hydraulic circuit the hydraulic motors are hydraulically connected in parallel, such that a single input flow of hydraulic fluid for driving the hydraulic motors, divides itself over the parallel connected hydraulic motors. Hydraulically connecting the respective hydraulic motors in parallel allows for a decrease in flow of hydraulic fluid through one of the hydraulic motors to be automatically balanced by an increase in flow of hydraulic fluid through the other one of the hydraulic motors. As a result of the automatic balancing of the parallel hydraulic flows through the hydraulic motors, the carts 5, 7 can each follow the additional motion associated with the heave motion of the subsea support frame 3, without both sets of tracked wheels 13 slipping. Hydraulically connecting the hydraulic motors in parallel has the disadvantage that in case one of the sets of tracked wheels 13 starts to slip, all of the hydraulic fluid tends to flow through the hydraulic motor of the slipping set of tracked wheels 13, thereby stopping the other set of tracked wheels 13 to stop being driven. In order to prevent one of the sets of tracked wheels 13 to stop being driven in case the other set of tracked wheels 13 starts slipping, each branch of the parallel hydraulic circuit is advantageously provided with a hydraulic flow limiter that set a maximum flow through the branch. Furthermore, each branch of the parallel hydraulic circuit is preferably configured to allow hydraulic flow in opposite directions, such that in case the additional motion as a result of heave motion of the subsea support frame 3 relative to the carts 5, 7, results in motion of the carts 5, 7, relative to the pipeline in opposite directions allows the hydraulic motors to rotate in opposite directions.

Figure 7:
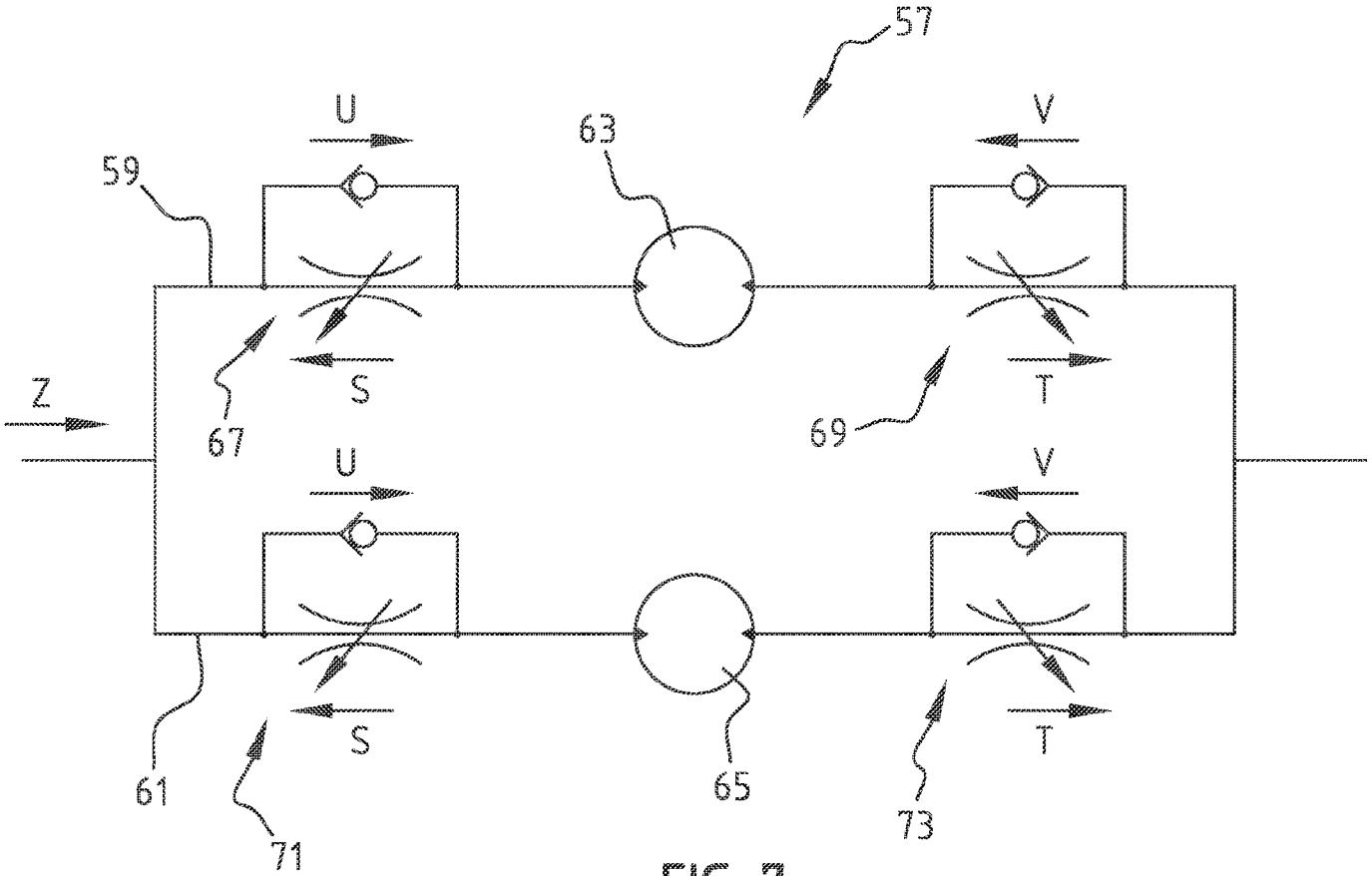
FIG. 7 a diagram of a hydraulic control circuit for driving hydraulic motors of the subsea trencher of FIGS. 1A, 1B and 2.

In FIG. 7 a parallel hydraulic control circuit 57 is shown that provides the above described functionality. The hydraulic control circuit 57 comprises two parallel branches 59, 61 that are both fed by a single input flow Z. Branch 59 feeds a hydraulic motor 63 that drives the set of tracked wheels 13 of cart 5. Branch 61 feeds a hydraulic motor 65 that drives the set of tracked wheels 13 of cart 7. Each of the branches 59, 61, comprises two flow limiters 67, 69, 71, 73. Each flow limiter 67, 69, 71, 73 allows flow in one direction. The two flow limiters 67, 69; 71, 73 of each branch 59, 61 each allow flow in one direction S, T, wherein the directions in which the two flow limiters 67, 69; 71, 73 allow flow are opposite. Each flow limiter 67, 69, 71, 73 is provided with a respective bypass valve 75, 77, 79, 81 that allows flow in direction U, V opposite to the flow direction of the associated flow limiter.

In the embodiment shown in the figures, the subsea support frame is arranged above the carts and the subsea pipeline, and is suspended from a surface vessel. Alternatively, the subsea support frame is supported by the seabed. In case supported by the seabed, the subsea support frame may straddle the subsea pipeline while the carts are supported by and run on the subsea pipeline. Alternatively, the subsea support frame may be supported by the seabed and be located beside the subsea pipeline, preferably at a location some distance away from the subsea pipeline. In case the subsea support frame is supported by the seabed and be located beside the subsea pipeline, the carts may be supported by and run on the subsea pipeline or may straddle the subsea pipeline and be supported by the subsea pipeline. In case the subsea support frame is supported on the seabed, the subsea support frame is preferably provided with wheels.

In the embodiment shown in the figures, the carts are supported by and run on the subsea pipeline. Alternatively, the carts straddle the pipeline and are supported by the seabed, while the subsea support frame is suspended from a surface vessel.

In the embodiment shown in the figures, the carts have a set of tracked wheels. Alternatively, the set of tracked wheels are replaced with one or more wheels without tracks.

In the embodiment shown in the figures, the carts have driven wheels. Alternatively the carts are provided with another type of propulsion. The carts may for instance be provided with thrusters.

In the embodiment shown in the figures, the subsea trencher is provided with two carts. Alternatively, the subsea trencher may be provided with one cart or more than two carts, such as, but not limited to, three, four, five, or six carts.

In the embodiments shown in the figures, trench tools are embodied by jet nozzles. Alternatively, mechanical trench tools are carried by the carts, such as mechanical cutters.

Although the principles of the invention have been set forth above with reference to specific embodiments, it must be understood that this description is given solely by way of example and not as limitation to the scope of protection, which is defined by the appended claims.

The invention claimed is:

1. A subsea trencher for arranging at least partly into the seabed a subsea pipeline laying on the seabed, the subsea trencher comprising:

at least one cart that separately carries at least one trench tool and is configured to run on the subsea pipeline, wherein the trench tool is configured to work the seabed underneath the subsea pipeline;

a subsea support frame, that carries, separately from the cart, heavy subsea equipment connected to the trench tool for operating the trench tool, and wherein:

when the subsea support frame is fixed to the cart, the cart supports the subsea support frame to press down substantially the entire assembled weight of the cart and the subsea support frame onto the subsea pipeline as the assembled cart and the subsea trencher run on the subsea pipeline, and when the subsea support frame and the cart are uncoupled from each other, substantially only the weight of the cart presses down onto the subsea pipeline as only the cart runs on the subsea pipeline, wherein, the subsea support frame is configured to be suspended above the seabed or arranged beside the subsea pipeline at a distance from the subsea pipeline sufficient to avoid the subsea trencher from sinking into the seabed as a consequence of the destabilizing effect of the trenching operation caused by the trench tool.

2. The subsea trencher according to claim 1, wherein the heavy subsea equipment comprises at least part of a heavy trench tool power supply that is connected to the trench tool for supplying power to the trench tool.

3. The subsea trencher according to claim 1, wherein the connecting structure is configured to allow at least one degree of freedom of relative motion between the cart and the subsea support frame while restricting at least one other degree of freedom of relative motion between the cart and the subsea support frame.

4. The subsea trencher according to claim 3, wherein the subsea support frame is configured to be suspended above or beside the pipeline, while the cart is configured to run along the subsea pipeline; and wherein:

the connecting structure is configured to allow heave motion of the subsea support frame relative to the cart.

5. The subsea trencher according to claim 3, wherein the subsea support frame is configured to be suspended above or beside the pipeline, while the cart is configured to run along the subsea pipeline; and wherein:

the connecting structure is configured to restrict swaying and/or surging motion of the subsea support frame relative to the cart.

6. The subsea trencher according to claim 3, wherein the cart is configured to run on the subsea pipeline; and the connecting structure is configured to restrict rolling motion of the cart relative to the subsea support frame.

7. The subsea trencher according to claim 3, wherein the connection structure comprises a connection arm that is at one end thereof rotatable connected to the subsea support frame and at another end thereof rotatable connected to the cart.

8. The subsea trencher according to claim 7, comprising: a plurality of connecting arms that are each at one end thereof rotatable connected to the subsea support frame and at another end thereof rotatable connected to at least one of the carts.

9. The subsea trencher according to claim 8, wherein the connecting arms are rotatable connected to the subsea support frame with a respective hinge; and the respective hinges are closely grouped, preferably in one group.

10. The subsea trencher according to claim 1, wherein the subsea trencher has at least one wheel that is configured to support on the subsea pipeline to load at least substantially the assembled weight of the cart and subsea support frame onto the subsea pipeline.

11. The subsea trencher according to claim 10, wherein:

the at least one wheel includes a tracked wheel set, the tracked wheel set comprises exchangeable track pads and/or exchangeable track shoes, and the at least one wheel includes a driven wheel for transport of the subsea trencher supported on the pipeline.

12. The subsea trencher according to claim 11, wherein:

the driven wheel is driven by a motor that is carried by the subsea trencher;

the motor is connected to a motor power supply; and at least part of the motor power supply is carried by the subsea support frame.

13. The subsea trencher according to claim 11, comprising:

at least two driven wheels driven by a respective motor; and a control system configured for controlling the drive speed of the driven wheels;

wherein:

the control system is configured to take into account any speed difference between the at least two driven wheels.

14. The subsea trencher according to claim 10, wherein the at least one wheel includes at least two guide wheels that are arranged for preventing side way movement relative to the subsea pipeline.

15. The subsea trencher according to claim 1, wherein the trench tool comprises a jet nozzle that is configured to direct a trenching fluid supplied thereto as a jet stream towards the seabed adjacent the pipeline for at least loosening the seabed below the subsea pipeline.

16. A method of arranging at least partly into the seabed a subsea pipeline laying on the seabed, the method comprising:

separately carrying at least one trench tool along the subsea pipeline by means of a cart that runs on the pipeline, and, using the trench tool, working the seabed underneath the subsea pipeline; and separately from the cart, carrying heavy subsea equipment connected to the trench tool for operating the trench tool, by means of a subsea support frame, when the subsea support frame is fixed to the cart, the cart supports the subsea support frame to press down substantially the entire assembled weight of the cart and subsea support frame onto the subsea pipeline as the assembled cart and subsea trencher run on the subsea pipeline, when the subsea support frame and the cart are uncoupled from each other, substantially only the weight of the cart presses down onto the subsea pipeline as only the cart runs on the subsea pipeline, suspending the subsea support frame above the seabed or arranging the subsea support beside the subsea pipeline at a distance from the subsea pipeline sufficient to avoid the subsea trencher from sinking into the seabed as a consequence of the destabilizing effect of the trenching operation caused by the trench tool.

17. The method according to claim 16, further comprising: running the cart on the subsea pipeline.

18. The method according to claim 16, further comprising:

carrying at least part of a trench tool power supply that is connected to the trench tool for supplying power to the trench tool by the subsea support frame, and suspending the subsea support frame from a surface vessel while running the cart along the subsea pipeline.

19. The method according to claim 16, wherein:

the cart has at least one wheel that is configured for supporting the cart, the at least one wheel including a driven wheel; and the running of the cart along the subsea pipeline comprises driving the at least one driven wheel.

20. The method according to claim 19, wherein: a plurality of carts carry at least one trench tool are run along the subsea pipeline, each having at least one wheel that is configured for supporting the cart, the at least one wheel including a driven wheel; and wherein the method comprises:

controlling the driving of the at least one driven wheel of at least one of the carts while taking into account the drive speed of the other carts.

21. The method according to claim 16, wherein:

the cart has at least one wheel that is configured for supporting the cart on the subsea pipeline; and the at least one wheel includes a tracked wheel set; and wherein the method comprises:

adapting the tracked wheel set to the subsea pipeline by exchanging track pads and/or track shoes of the tracked wheel set.

* * * * *